US008622209B2

(12) United States Patent
Isaac et al.

(10) Patent No.: US 8,622,209 B2
(45) Date of Patent: Jan. 7, 2014

(54) CONTAINER FOR MIXING

(75) Inventors: Thomas L. Isaac, Newnan, GA (US); Joel Tenney, Marietta, GA (US)

(73) Assignee: ICA Trinova, LLC, Newman, GA (US)

( * ) Notice: Subject to any disclaimer, the term of this patent is extended or adjusted under 35 U.S.C. 154(b) by 244 days.

(21) Appl. No.: 13/156,871

(22) Filed: Jun. 9, 2011

(65) Prior Publication Data

US 2012/0312706 A1 Dec. 13, 2012

(51) Int. Cl.
*B65D 25/08* (2006.01)

(52) U.S. Cl.
USPC ..... 206/222

(58) Field of Classification Search
USPC ..... 206/219–222, 568; 215/DIG. 8; 222/83, 222/129, 145.1; 426/115–120
See application file for complete search history.

(56) References Cited

U.S. PATENT DOCUMENTS

| | | | | |
|---|---|---|---|---|
| 2,026,393 | A | 12/1935 | Linck et al. | |
| 2,157,953 | A | 5/1939 | De Long et al. | |
| 3,347,410 | A * | 10/1967 | Schwartzman | 206/222 |
| 4,526,320 | A | 7/1985 | von Philipp et al. | |
| 4,938,144 | A | 7/1990 | Demarest | |
| 5,209,909 | A * | 5/1993 | Siegel et al. | 206/219 |
| 5,278,112 | A | 1/1994 | Klatte | |
| 5,314,852 | A | 5/1994 | Klatte | |
| 5,464,598 | A | 11/1995 | Klatte | |
| 5,567,405 | A | 10/1996 | Klatte et al. | |
| 5,573,743 | A | 11/1996 | Klatte et al. | |
| 5,730,948 | A | 3/1998 | Klatte et al. | |
| 5,776,850 | A | 7/1998 | Klatte et al. | |
| 5,833,739 | A | 11/1998 | Klatte et al. | |
| 5,853,689 | A | 12/1998 | Klatte | |
| 5,885,543 | A | 3/1999 | Klatte | |
| 6,174,508 | B1 | 1/2001 | Klatte | |
| 6,219,960 | B1 | 4/2001 | Contadini et al. | |
| 6,379,643 | B1 | 4/2002 | Klatte | |
| 6,423,289 | B1 | 7/2002 | Klatte | |
| 6,458,735 | B1 | 10/2002 | Klatte | |
| 6,503,419 | B2 | 1/2003 | Klatte | |
| 6,533,113 | B2 | 3/2003 | Moscovitz | |
| 6,605,558 | B2 | 8/2003 | Klatte | |
| 6,635,230 | B2 | 10/2003 | Klatte | |
| 6,726,005 | B2 * | 4/2004 | Lentine | 206/222 |
| 6,792,713 | B2 | 9/2004 | Snell | |
| 7,243,788 | B2 | 7/2007 | Schmidt et al. | |
| 7,347,994 | B2 | 3/2008 | Tenney et al. | |
| 7,584,842 | B2 | 9/2009 | Neumeyer et al. | |
| 7,721,880 | B2 | 5/2010 | Pearce et al. | |
| 7,789,227 | B2 | 9/2010 | Levine | |
| 7,922,992 | B2 | 4/2011 | Ernst et al. | |
| 8,100,294 | B2 | 1/2012 | May et al. | |
| 2003/0150748 | A1 | 8/2003 | Crawley | |
| 2004/0200742 | A1 * | 10/2004 | Cho | 206/219 |
| 2005/0218015 | A1 * | 10/2005 | Spector | 206/222 |
| 2006/0101707 | A1 | 5/2006 | James | |
| 2010/0206174 | A1 * | 8/2010 | Loden | 220/568 |
| 2010/0315897 | A1 * | 12/2010 | Renna et al. | 366/130 |

(Continued)

*Primary Examiner* — Luan K Bui
(74) *Attorney, Agent, or Firm* — Meunier Carlin & Curfman, LLC.

(57) ABSTRACT

A self-contained generator/fumigator and delivery system is described herein that provides for sealed containment to store, isolate and protect two or more solid and/or liquid reactants in separate chambers. Upon activation, the container facilitates robust mixing of the reactants, the containment thereof and allows the release of a pre-determined amount of gaseous products, e.g., chlorine dioxide, carbon dioxide and others, into a targeted volume of water, air or other solution.

12 Claims, 6 Drawing Sheets

(56) References Cited

U.S. PATENT DOCUMENTS

2011/0174330 A1 7/2011 Schatteman et al.
2011/0180545 A1* 7/2011 Marino et al. ..... 220/568
2011/0253564 A1 10/2011 Fernandez de Castro
2011/0272379 A1 11/2011 Eghbaly
2013/0126370 A1 5/2013 DiLiberto et al.

* cited by examiner

CONTAINER FOR MIXING

FIELD

Containers and, in particular, containers for selective mixing of materials, are described herein.

BACKGROUND

Containers available in the prior art may be used to hold multiple materials and be configured for selective distribution of those containers. When those materials mix and cause a release of gasses, however, it can be difficult to properly manage mixture and release of the gasses in a safe and efficient way.

SUMMARY

The containers and methods of mixing a plurality of materials described herein overcome the problems of the prior art by allowing selective combination of a plurality of materials. Included in the container are a base, a seal and a lid. The base defines at least two cavities wherein each cavity is configured to contain one of the plurality of materials. Separating the two cavities is the seal which is configured to hold the plurality of materials therein. Also, the lid is configured to rotate with respect to the base and puncture the seal so as to allow intermixing of the plurality of materials.

For example, the lid may include a cutter configured to puncture the seal. The cutter may be configured to be advanced through the seal when the lid is in at least one rotational position with respect to the base.

The lid may include a skirt configured to extend around a peripheral wall of the base. For example, the skirt may have a cylindrical shape extending over a congruent cylindrical shape of the base.

Also, the peripheral wall of the base and the lid may include a retaining ledge and a retaining clip configured to extend over the retaining ledge so as to hold the base and lid together. For example, the base may define at least one retention slot configured to receive the retaining clip supported by the lid as the cutter is advanced through the seal. This locks the base and lid together against further movement.

The retaining clip may have the structure of a pawl with a tooth at its free end for engaging the retention slot.

Also, the lid may include a sealing track configured to abut a base sealing rim when the lid punctures the seal. A portion of the seal may be trapped between the lid sealing track and the base sealing rim after puncture to further enhance retention of the materials in the container.

The lid may include a cutter configured for advancement through the seal when the lid is in at least one rotational position with respect to the base. And, the cutter may be configured to extend adjacent to the base sealing rim and internal to a respective one of the cavities when the seal is punctured. In this configuration, the cutter may have an outer surface closest to the base sealing rim and a free cutting edge positioned further from the base sealing rim than the outer surface. Such a configuration causes the seal, when cut, to leave a tail end between the cutter and base sealing rim. For example, the tail end may extend onto the cutter and substantially entirely along the base sealing rim to further enhance retention of materials in the container.

The cutter may be a saw tooth cutter that includes a plurality of teeth. A divider of the base may be positioned between one or more cavities and the cutter may include a gap or gaps to provide clearance for the divider.

Defined in the lid may be a plurality of perforations to let gasses escape from the container. A semi-permeable membrane may help to restrain powder or small materials while still selectively allowing gasses to escape.

The base may include a guide track to guide the base for filling of the cavities and an alignment key configured to align the base and its guide track.

For additional security against premature or inadvertent opening, the lid may include a key (or vice-versa) and the base a keyway which are configured to fit together when the lid and base are aligned to allow puncture of the seal. In the case of the lid having a skirt and the base peripheral walls, alignment of the key and keyway allow an increase in skirt and peripheral wall overlap along with puncture of the seal.

A method of mixing a plurality of materials using the container is also possible including rotating a lid with respect to a base, puncturing a seal covering at least two cavities and mixing the materials together after they are freed from their respective cavities.

Puncturing the seal may include advancing a cutter through the seal when the lid is in at least one rotational position with respect to the base. Rotating the lid includes sliding a retaining clip along a retaining ledge until a key fits a keyway. And, at this point, the method may include compressing the lid and the base together to puncture the seal.

An interface between the lid and the base may be sealed against leakage with a portion of the punctured seal. Further, the user may shake the container to mix the materials in a space defined in the lid.

These and other features and advantages will become more readily apparent to those skilled in the art upon consideration of the following detailed description and accompanying drawings.

DETAILED DESCRIPTION

The containers and methods of mixing a plurality of materials will now be described more fully hereinafter with reference to specific embodiments of the invention. Indeed, the containers and methods of mixing a plurality of materials can be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise. The term "comprising" and variations thereof as used herein is used synonymously with the term "including" and variations thereof and are open, non-limiting terms.

Figure 5:
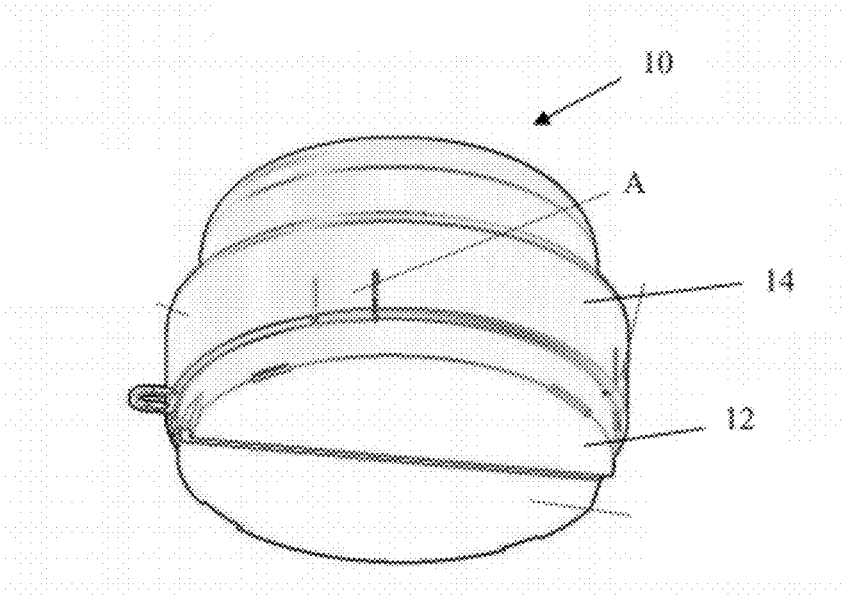
FIG. 5 is a perspective view of the assembled lid and base of FIGS. 1A and 2A to form a container in a passive or storage configuration.
Figure 6:
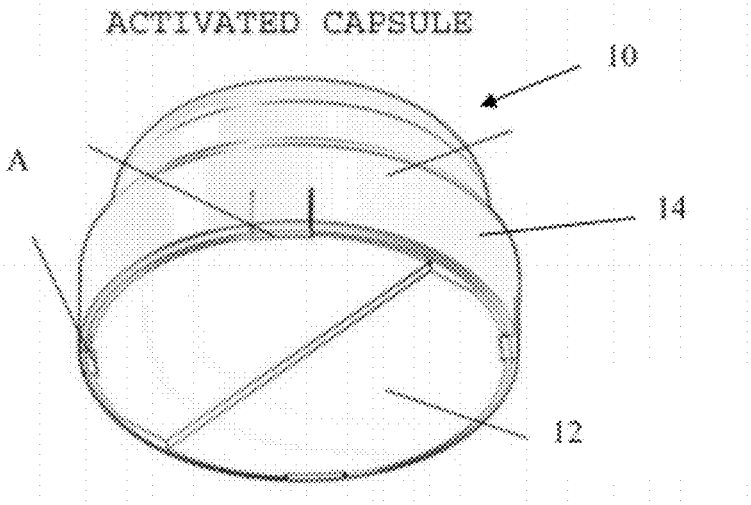
FIG. 6 is a perspective view of the container of FIG. 5 in the activated position wherein mixing of the stored materials is possible.

As shown in the FIGS. 5 and 6, the container can include a self-contained generator/fumigator and delivery system including a container 10 that provides for sealed containment to store, isolate and protect two or more solid and/or liquid reactants (or other materials) in separate chambers or cavities L. Upon activation, the container 10 facilitates robust mixing of the reactants, the containment thereof and allows the release of a pre-determined amount of gaseous products, e.g., chlorine dioxide, carbon dioxide and others, into a targeted volume of water, air or other solution. Suitable reactants and gaseous products are described, for example, in U.S. Pat. Nos. 7,922,992, 7,347,994, 6,635,230, 6,605,558, 6,503,419, 6,458,735, 6,423,289, 6,379,643, 6,174,508, 5,885,543, 5,853,689, 5,833,739, 5,776,850, 5,730,948, 5,573,743, 5,567,405, 5,464,598, 5,314,852, and 5,278,112, which are incorporated by reference herein in their entirety.

Container

The container 10 may be constructed of a rigid material to protect the components as well as provide a convenient activation method for a user. The container 10 can be scaled to allow for larger or smaller amounts of chemical storage and reaction. The container 10 may be disposable or can be recycled or returned for reuse of all or portions of the container 10.

In addition to use for containment, storage and as a self-contained generator and/or fumigator and delivery system, the container 10 also allows for filling in a totally automated process. Automated filling is an enhancement designed to accommodate high rate manufacturing. The container 10 may also be filled wholly or partially manually rather than in a fully automated mode.

As shown in FIGS. 5 and 6, the container 10 may include a base 12, a seal S and a lid 14. It should be noted that the terms base and lid are used interchangeably and the orientation of the two components is arbitrary for convenience of describing them in the figures. The base defines at least two cavities L, with each cavity configured to contain a material. The seal S separates the two cavities L and is configured to hold the materials in the cavities. The lid 14 is configured to rotate with respect to the base 12 and such rotation punctures the seal S, releasing the materials from the cavities L and allowing them to be mixed together in a mixing chamber F defined by the lid.

It should be noted that the materials may include multiple reactants stored in isolation in storage cavities L within the container 10 to simplify packaging and storage of reactants necessary to generate a reaction product at the time of application, as shown in FIG. 2.

Figure 1A:
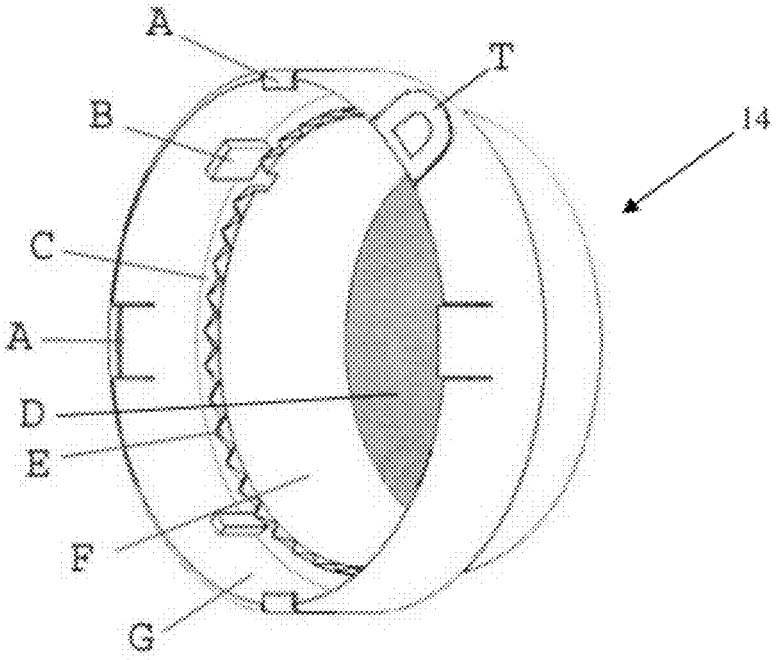
FIGS. 1A and 1B are perspective views of a lid of a container of one embodiment.
Figure 1B:
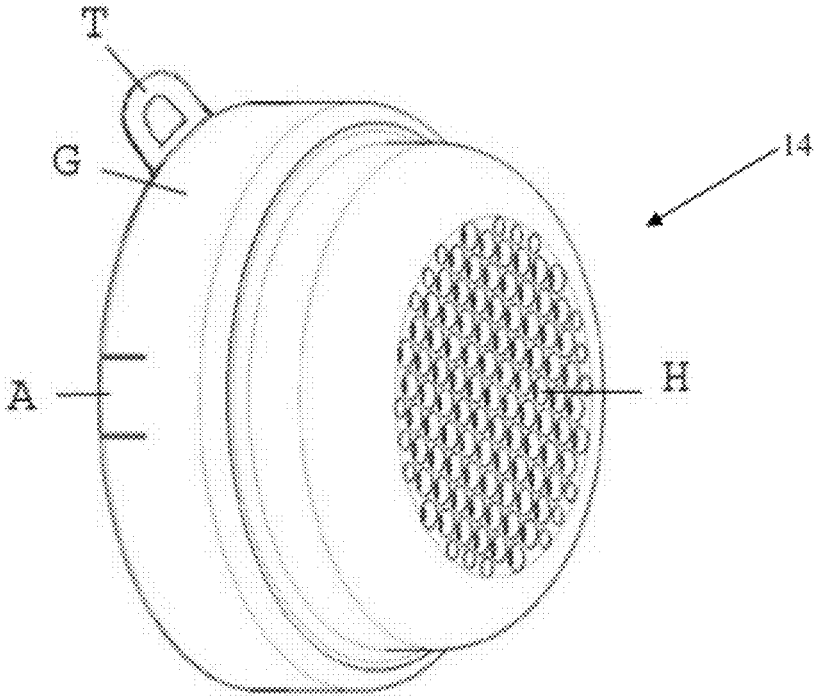

As shown in FIGS. 1A and 1B, index/support keys B may be molded into the lid 14 and, when the lid 14 and base 12 are coupled, rest on a base guide/support track I on the base 12 (FIGS. 2A-C) to prevent premature activation of the chemical reaction. Unique width index/support keys B and index/closure keyways N protect against accidental activation and insure proper orientation for a plurality of saw tooth cutters E over the storage cavity L to shear the bonded sealing film S during activation. The container requires a twisting or rotating action to line up the index/support keys B and index/closure keyways N before activation can occur.

The saw tooth cutters E are configured to shear the bonded sealing film S and release the reactants into a mixing chamber F to begin the reaction when the keys and keyways are aligned and the lid 14 and base 12 are compressed together. As shown in FIG. 6, after compression past a threshold distance, lid retaining clips A lock the lid 14 and base 12 together to provide a tamper resistant package both before and after activation.

Figure 3:
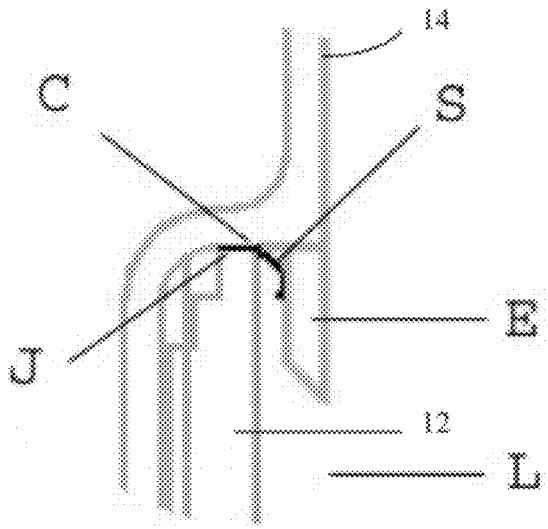
FIG. 3 is an enlarged sectional view of an interface between the lid and base of FIGS. 1A and 2A.

As shown in FIG. 3, advantageously, the container 10 provides for a sealing effect to contain the reactants after release into the mixing chamber F by surface contact between a base sealing rim J on the base 12 and a lid sealing track C on the lid 14. In particular, a "gasket effect" is created by a cut remnant or portion or tail end of the bonded sealing film S left around the perimeter of the base 14 that contacts the solid portion of the saw tooth cutters E after shearing.

A semi-permeable membrane D included in the lid, surface contact and "gasket effect" (FIG. 3) contain the mixture and prevent contact with the user.

The container 10 may work to contain and mix solid media, liquid media or combinations of solid and liquid media. For example, multiple reactants may be stored in individual cavities separated by one or more internal divider(s) in the container base 12. As illustrated in the figures, the container base 12 contains two cavities but could be modified to include three or more cavities. During assembly, the reactants are placed in the cavities and the entire top surface of the base 12 is sealed using the bonded sealing film S. The film isolates the reactants from each other during storage. The container 10 protects the seal S to keep the reactants separated until it is desirable to mix the reactants.

Figure 2A:
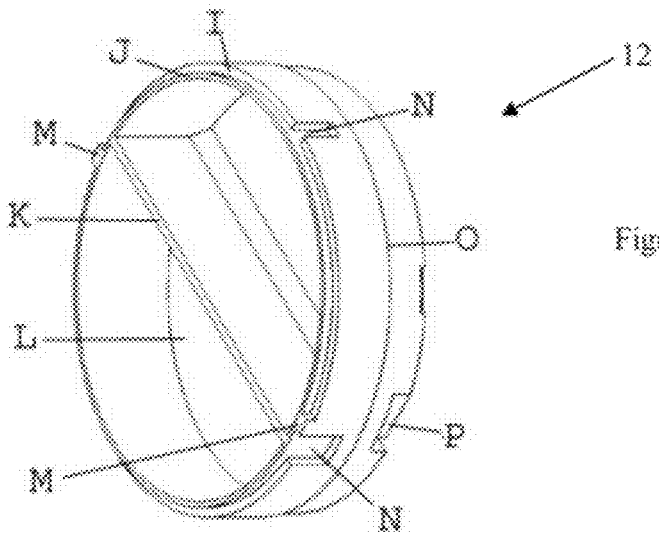
FIGS. 2A, 2B and 2C are perspective views of a base of the container of FIGS. 1A and 1B.
Figure 2B:
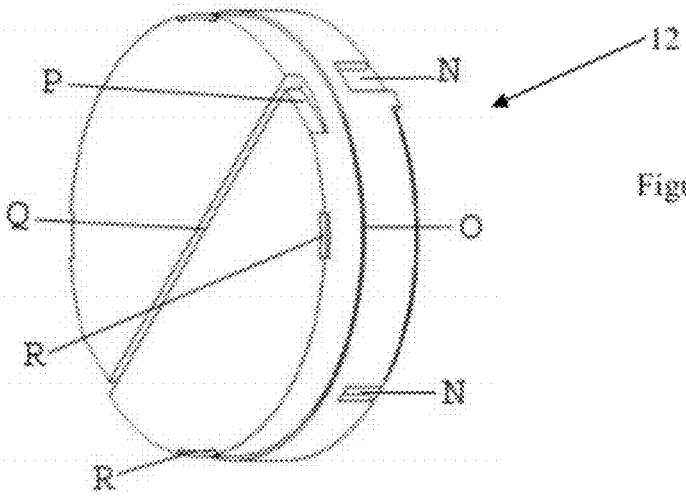
Figure 2C:
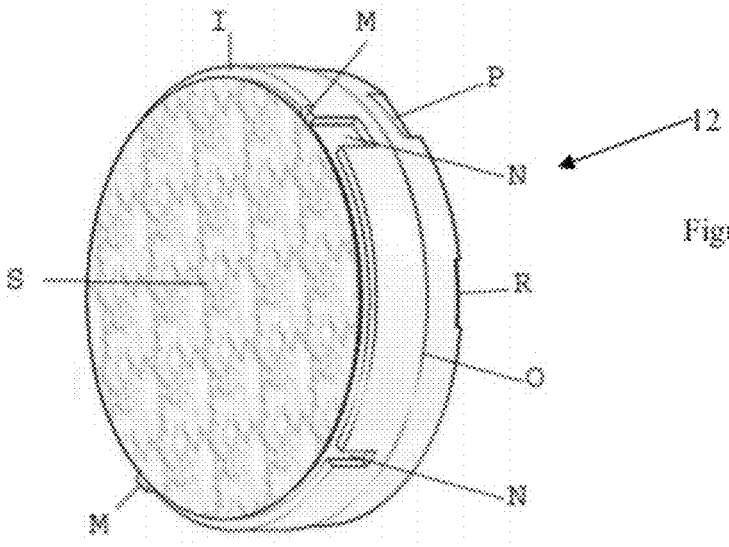

The generator lid 14 may also act as an activating mechanism, mixing chamber and release path to facilitate the discharge of the gas generated from the reaction, as shown in FIGS. 1A and 1B. The lid 14 is configured to turn counter-clockwise until it contacts an alignment stop M, as shown in FIGS. 2A-C. At this position index/support keys B and index/closure keyways N are aligned to allow the lid 14 to be compressed onto the base 12. Once the lid and base are compressed past a certain distance, the external lid retaining clips A latch into clip retention slots R on the bottom of the base.

Figure 4:
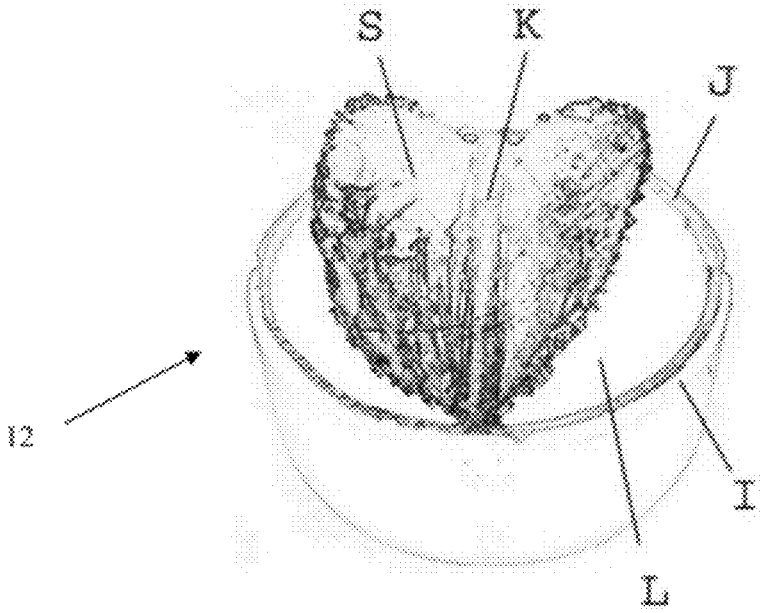
FIG. 4 is a perspective view of the base of FIG. 2A with a punctured seal.

Internal saw tooth cutters E formed into the lid slice the bonded sealing film S attached to the base sealing rim J on the top edge of the base, as shown in FIG. 3. The ruptured bonded sealing film S, as shown in FIG. 4, releases the stored reactants into the mixing chamber F. Reactants are mixed in the mixing chamber F by agitation or shaking of the generator container.

As shown in FIGS. 1A and 1B, a plurality of lid perforations H on the top of the lid 14 are covered by the semi-permeable membrane D bonded to the interior surface of the lid. The semi-permeable membrane D allows gaseous products to escape from the generator container while preventing the mixed reactants from being discharged. A suspension loop T is attached to the lid to allow the container 10 to be hung at the point of application.

Variations of the container and system disclosed herein particularly suitable for carbon dioxide, chlorine dioxide, vaporous hydrogen peroxide and other similar reaction systems.

Lid/Mixing Chamber

As noted above, the lid/mixing chamber may include the retaining clips A, the index/closure keyways N, the lid sealing track C, the saw tooth cutters E, the mixing chamber F, the lid perforations H and the semi-permeable membrane D, as shown in FIGS. 1A and 1B. Additional aspects of these components are described hereinbelow.

The retaining clips A may be pawl-like structures formed on the open end and are inwardly biased to engage a lid retaining ring O on the base 12 to hold the lid 14 in a passive (storage) position, as shown in FIG. 5. The retaining clips A are configured to engage clip retention slots R to lock the base 12 within the lid 14 in the activated (reaction) position, as shown in FIG. 6.

The unique width index/support keys B are molded on the inside of a guide skirt G to provide support for the lid 14 against the base guide/support track I, as shown in FIGS. 2A-C. In a passive (storage) position, this structure allows the lid 14 to be depressed only when appropriately aligned over the correspondingly sized index/closure keyways N molded into the base 12.

The lid sealing track C is designed to contact the base sealing rim J and gives full perimeter contact when the container 10 is fully engaged in the active position providing stability and a sealing effect to inhibit reactants from leaking out of the container after activation, as shown in FIG. 3.

Two (or more) sets of the saw tooth cutters E are located so as to shear the bonded sealing film S around the perimeter of each storage cavity L in the base 12 when the container 10 is activated, as shown in FIG. 4. The saw tooth cutters E are designed to have a sloped outer perimeter that has a greater diameter at the bottom than at the teeth in order to leave a small ring of the bonded sealing film S attached at the perimeter of each storage cavity L, resulting in a "gasket effect" after the bonded sealing film S is pierced. This configuration enhances the sealing effect at the interface where the lid sealing track C contacts the base sealing rim J, as shown in FIG. 3.

The internal mixing chamber F is unobstructed to allow the reactants to mix after the bonded sealing film S is ruptured. However, the semi-permeable membrane D is bonded to the interior of the lid over the lid perforations H so as to completely cover the lid perforations H and prevent the reactants from exiting the container after the bonded sealing film S is ruptured, during mixing and during the generation phase. The lid perforations H defined in the top of the lid 14 allow the generated gas to escape into the surrounding environment.

It should be noted that the lid may not have such perforations and the semi-permeable membrane is optional. Also, it may be advantages to have the perforations open when distribution of powder or mixed reactants is desired, such as for a pesticide.

An optional flexible, compressible gasket can be added to the lid sealing track C that contacts the base sealing rim J on the base to enhance the seal after activation.

Base with Cavities

The base 12 may include the storage cavity divider K, storage cavities L, base sealing rim J, bonded sealing film S, base guide/support track I, alignment stop M, index/closure keyways N, lid retaining ring O, clip retention slots R, filing alignment key P and fill guide track Q, as shown in FIGS. 2A-C.

The storage cavity divider K sub-divides the storage cavity L into multiple cavities to hold and isolate reactants during storage. The uniform height base sealing rim J on the top edge allows the bonded sealing film S to be applied to seal the storage cavities L and isolate them from each other.

The base guide/support track I around the top edge, outside and below the base sealing rim J, supports index/support keys B molded into the lid 14 to prevent premature rupture of the bonded sealing film S.

Alignment stop(s) M are positioned at specific points on the base guide/support track I provide an end-point for the rotation of the lid and align the index/support keys B with the index/closure keyways N. These stops align the lid 14 and allow it to be depressed to rupture the bonded sealing film S, releasing the reactants for mixing.

The Index/Closure Keyways N have a unique width and are located around the perimeter of the base 12 and are sized to allow the lid 14 to be depressed only when appropriately oriented over the base 12.

The molded and recessed lid retaining ring O is positioned mid-way between the top and bottom of the base 12, and around the outside of the perimeter, is configured to engage the lid retaining clips A so as to retain the lid 14 in the passive (storage) position during storage prior to activation of the container 10.

The clip retention slots R may be molded on the bottom edge of the base 12 and are sized to accept the lid retaining clips A on the lid 14 after activation. This provides some "child/tamper-resistance" and reduces the possibility of opening the container and spilling the contents.

As will be described in more detail below, the filling alignment key P on the base 12 allows automated orientation of the container 12 for filling. Also, the fill guide track Q maintains proper orientation and transport of the container 10 during automated filling.

Automated Filling

Figure 7:
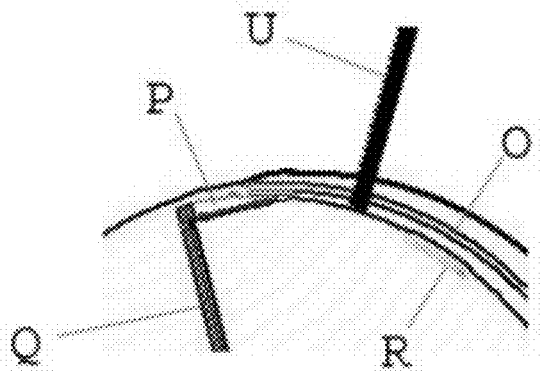
FIG. 7 is an enlarged perspective view of the base of FIG. 2A showing interception of a guide bar of a conveyor system with the base.
Figure 8:
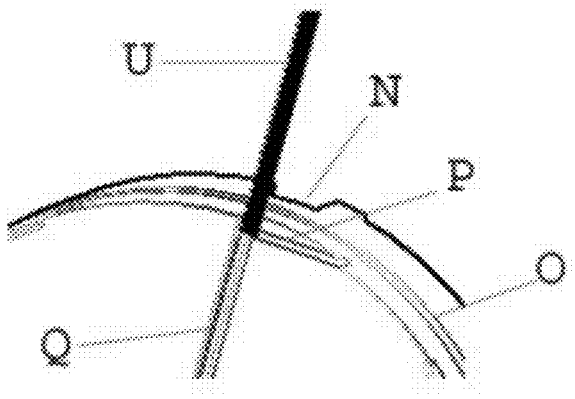
FIG. 8 is an enlarged perspective view of the base aligned with the guide bar of FIG. 7.
Figure 9:
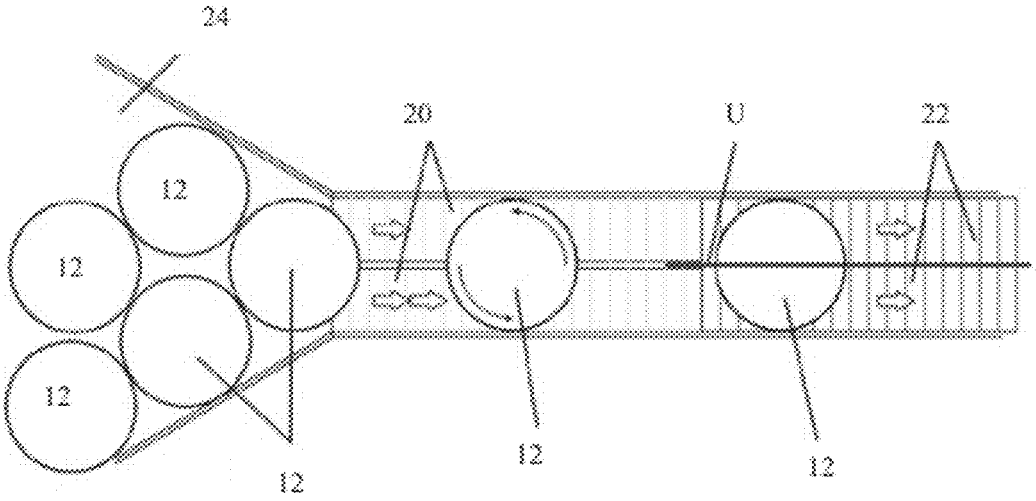
FIG. 9 is a plan view of a conveyor system for filling the base of FIG. 2A.

For automated filling, as shown in FIGS. 7-9, a plurality of bases 12 are placed on a feed chute 24 and travel down onto a differential conveyor 20, such as a split conveyor that has tracks running at slightly different speeds. The differential conveyor 20 rotates each base 12 while moving it into contact with a guide bar U that is centered between the conveyer tracks.

The guide bar U stops the base 12 from advancing into a filling unit station while the differential speed of the differential conveyor 20's tracks causes the base 12 to slowly rotate counterclockwise around its center axis.

As the base 12 rotates, the filling alignment key P, allows the base 12 to move forward against the guide bar U until the deepest recessed portion of the filling alignment key P stops the rotation when the filling alignment key P meets the fill guide track Q.

Once the fill guide track Q is aligned with the guide bar U, the base 12 can advance along the guide bar U toward a concurrent conveyor 22 and the filling station.

Meanwhile, the guide bar U maintains the proper orientation of the base 12 during transport regardless of the differential speed of the differential conveyor 20 and during transport by the concurrent conveyor 22.

The concurrent conveyor 22 moves the base 12 forward to the filling station where sensors control the filling and settling of the media into the respective storage cavities L.

After filling, the base 12 travels to a sealing station for placement of the bonded sealing film S.

A number of aspects of the systems, devices and methods have been described. Nevertheless, it will be understood that various modifications may be made without departing from the spirit and scope of the disclosure. Accordingly, other aspects are within the scope of the following claims.

That which is claimed:

1. A container for allowing selective combination of a plurality of materials, the container comprising:

a base comprising a peripheral wall defining an interior portion and at least one divider wall extending through the interior portion, the divider wall and peripheral wall defining at least two cavities, each cavity configured to contain one of the plurality of materials, the base further comprising a base sealing rim adjacent an upper perimeter of the peripheral wall a lid configured to rotate with respect to the base to align a keyway and a key, one of the lid or the base including the keyway and the other of the lid or the base including the key, the lid comprising a cutter and a lid sealing track; and at least one seal extending over and being bonded to the divider wall and the base sealing rim, the seal being configured to hold the plurality of materials in the respective cavities, wherein:

upon alignment of the key and the keyway, the lid is configured to be moved vertically toward the base and puncture the seal with the cutter so as to allow intermixing of the plurality of materials, upon puncture of the seal, the lid sealing track is configured to abut the base sealing rim and trap an outermost portion of the seal between the base sealing rim and the lid sealing track, engagement of the key in the keyway prevents rotation of the lid with respect to the base while the seal is being punctured, the cutter is configured to cut the seal adjacent the outermost portion of the seal such that the seal remains bonded to the divider wall and a tail end portion of the seal is disposed between the cutter and the peripheral wall of the base, the tail end portion being disposed radially inwardly from and adjacent the outermost portion of the seal, and wherein upon puncture of the seal, the seal does not obstruct the materials from exiting the cavities, the lid defines a plurality of perforations configured to let gasses escape therethrough, and the lid includes a semi-permeable membrane covering the perforations, the membrane being bonded to an interior surface of the lid.

2. A container of claim 1, wherein the lid includes a skirt configured to extend around the peripheral wall of the base.

3. A container of claim 2, wherein the peripheral wall of the base includes one of a retaining ledge or a retaining clip and the lid includes another one of the retaining ledge and retaining clip, wherein the retaining clip is configured to extend over the retaining ledge so as to hold the base and lid together.

4. A container of claim 3, wherein one of the base or the lid defines at least one clip retention slot configured to receive the retaining clip therein when the cutter is advanced through the seal so as to lock the base and lid together against further movement.

5. A container of claim 1, wherein the cutter extends adjacent to the base sealing rim and is disposed internal to a respective one of the cavities when the seal is punctured.

6. A container of claim 5, wherein the cutter has an outer surface closest to the base sealing rim and a free cutting edge positioned further from the base sealing rim than the outer surface.

7. A container of claim 6, wherein the the tail end portion extends between the outer surface of the cutter and the base sealing rim.

8. A container of claim 1, wherein the base includes a guide track configured to guide the base for filling of the cavities.

9. A container of claim 8, wherein the base defines a guide track alignment key configured to align the base and its guide track.

10. A container of claim 1, wherein the lid and base include overlapping skirt and peripheral walls.

11. A container of claim 10, wherein alignment of the key and keyway allow compression of the lid and base together to increase overlap of the skirt and peripheral walls along with puncture of the seal.

12. A container of claim 11, wherein sufficient space remains between the compressed lid and base to allow intermixing of the materials in a mixing space defined by the lid and the base after puncture of the seal.

* * * * *